US007410628B2

(12) United States Patent
Bening et al.

(10) Patent No.: US 7,410,628 B2
(45) Date of Patent: Aug. 12, 2008

(54) SURFACE TREATMENT OF CARBON MICROFIBERS

(75) Inventors: Robert C. Bening, Sunderland, MA (US); Thomas J. McCarthy, Amherst, MA (US)

(73) Assignee: Hyperion Catalysis International, Inc., Cambridge, MA (US)

( * ) Notice: Subject to any disclaimer, the term of this patent is extended or adjusted under 35 U.S.C. 154(b) by 440 days.

(21) Appl. No.: 11/212,441

(22) Filed: Aug. 26, 2005

(65) Prior Publication Data

US 2007/0280874 A1 Dec. 6, 2007

Related U.S. Application Data

(63) Continuation of application No. 10/830,646, filed on Apr. 23, 2004, now abandoned, which is a continuation of application No. 10/041,165, filed on Jan. 8, 2002, now abandoned, which is a continuation of application No. 08/329,774, filed on Oct. 27, 1994, now abandoned, which is a continuation of application No. 08/117,873, filed on Sep. 7, 1993, now abandoned, which is a continuation of application No. 07/823,021, filed on Jan. 15, 1992, now abandoned.

(51) Int. Cl.
*D01F 9/12* (2006.01)

(52) U.S. Cl. ..... 423/447.1; 423/460

(58) Field of Classification Search ..... 423/447.1, 423/460

See application file for complete search history.

(56) References Cited

U.S. PATENT DOCUMENTS

| | | | |
|---|---|---|---|
| 3,746,560 | A | 7/1973 | Goan et al. |
| 3,964,952 | A | 6/1976 | Brie et al. |
| 3,989,802 | A | 11/1976 | Joo et al. |
| 4,284,615 | A | 8/1981 | Maruyama |
| 4,388,289 | A | 6/1983 | Shepherd et al. |
| 4,663,230 | A | 5/1987 | Tennent |
| 4,816,289 | A | 3/1989 | Komatsu et al. |
| 4,855,122 | A | 8/1989 | Kitomura et al. |
| 5,346,683 | A | 9/1994 | Green et al. |

FOREIGN PATENT DOCUMENTS

| | | |
|---|---|---|
| FR | 2178748 | 5/1972 |
| GB | 9922 | 5/1872 |
| JP | 56160311 | 12/1981 |
| JP | 61225325 | 10/1986 |
| JP | 61225326 | 10/1986 |
| JP | 62263377 | 11/1987 |
| JP | 62276082 | 11/1987 |
| JP | 63286468 | 11/1988 |
| WO | 8707559 | 12/1987 |

OTHER PUBLICATIONS

Baker, Carbon 27: 315-23 (1989).
"Carbon Fibers", pp. 640-663.

*Primary Examiner*—Stuart Hendrickson
(74) *Attorney, Agent, or Firm*—Kramer Levin Naftalis & Frankel LLP; Barry Evans, Esq.

(57) ABSTRACT

A method of oxidizing the surface of carbon microfibers that includes contacting the microfibers with an oxidizing agent that includes sulfuric acid and potassiaum chlorate under reaction conditions sufficient to oxidize the surface. The invention also features a method of decreasing the length of carbon microfibers that includes contacting the microfibers with an oxidizing agent under reaction conditions sufficient to decrease the length.

8 Claims, No Drawings

SURFACE TREATMENT OF CARBON MICROFIBERS

This is a continuation of U.S. Ser. No. 10/830,646, filed Apr. 23, 2004, which is a continuation of U.S. Ser. No. 10/041,165, filed Jan. 8, 2002, now abandoned, which is a continuation of U.S. Ser. No. 08/329,774, filed Oct. 27, 1994, now abandoned, which is a continuation of U.S. Ser. No. 08/117,873 filed Sep. 7, 1993, now abandoned, which is a continuation of U.S. Ser. No. 07/823,021 filed Jan. 15, 1992, now abandoned, all of which are hereby incorporated by reference.

BACKGROUND OF THE INVENTION

This invention relates to modifying the surface of carbon microfibers.

Carbon microfibers (i.e. fibers having very small diameters, typically less than 1 micron) are known. Microfibers having diameters less than 0.5 micron are often referred to as fibrils. Examples of such microfibers and methods for preparing them are described in Tennent, U.S. Pat. No. 4,663,230 ("Carbon Fibrils, Method for Producing Same and Compositions Containing Same"), Tennent et al., U.S. Ser. No. 871,676 filed Jun. 6, 1986 ("Novel Carbon Fibrils, Method for Producing Same and Compositions Containing Same"), Tennent et al., U.S. Ser. No. 871,675 filed Jun. 6, 1986 ("Novel Carbon Fibrils, Method for Producing Same and Encapsulated Catalyst"), Tennent et al., U.S. Ser. No. 149,573 filed Jan. 28, 1988 ("Carbon Fibrils"), and Mandeville et al., U.S. Ser. No. 285,817 filed Dec. 16, 1988 ("Fibrils"), all of which are assigned to the same assignee as the present application and are hereby incorporated by reference.

SUMMARY OF THE INVENTION

In a first aspect, the invention features a method of oxidizing the surface of carbon microfibers that includes contacting the microfibers with an oxidizing agent that includes sulfuric acid ($H_2SO_4$) and potassium chlorate ($KClO_3$) under reaction conditions (e.g., time, temperature, and pressure) sufficient to oxidize the surface.

In a second aspect, the invention features a method of decreasing the length of carbon microfibers that includes contacting the microfibers with an oxidizing agent under reaction conditions (e.g., time, temperature, and pressure) sufficient to decrease the length by chopping the microfibers. Preferably, the oxidizing agent includes sulfuric acid and potassium chlorate.

In preferred embodiments, the oxidizing agent is in the liquid phase. The microfibers preferably have diameters no greater than 1 micron (more preferably no greater than 0.1 micron). Even more preferred are microfibers having diameters between 3.5 and 75 nanometers, inclusive. Particularly preferred are microfibers that are tubes having graphitic layers that are substantially parallel to the microfiber axis. One aspect of substantial parallelism is that the projection of the graphite layers on the microfiber axis extends for a relatively long distance in terms of the external diameter of the microfiber (e.g., at least two microfiber diameters, preferably at least five diameters), as described in Tennent et al., U.S. Ser. No. 149,573. These microfibers preferably are also free of a continuous thermal carbon overcoat (i.e. pyrolytically deposited carbon resulting from thermal cracking of the gas feed used to prepare the microfibers).

The microfibers prepared according to the above-described process may be incorporated in a matrix.

Preferably, the matrix is an organic polymer (e.g., a thermoset resin such as epoxy, bismaleimide, polyimide, or polyester resin; a thermoplastic resin; a reaction injection molded resin; or an elastomer such as natural rubber, styrene-butadiene rubber, or cis-1,4-polybutadiene), an inorganic polymer (e.g., a polymeric inorganic oxide such as glass), a metal (e.g., lead or copper), or a ceramic material (e.g., Portland cement). The microfibers may also form an adsorbent or a polymerization initiator.

The invention also features a volume of carbon fibrils that includes a multiplicity of fibrils having a morphology consisting of tubes that are free of a continuous thermal carbon overcoat and have graphitic layers that are substantially parallel to the fibril axis, the outer surface of the graphitic layers having bonded thereto a plurality of oxygen-containing groups (e.g., a carbonyl, carboxylic acid, carboxylic acid ester, epoxy, vinyl ester, hydroxy, alkoxy, isocyanate, or amide group), or derivatives thereof (e.g., a sulfhydryl, amino, or imino group).

The invention provides a simple and effective method for introducing, through an oxidation reaction, a wide variety of functional groups onto the surface of microfibers. Moreover, the treatment does not leave heavy metal residues on the surface of the microfibers. The invention also effectively reduces microfiber length by "chopping up" the microfibers. Reducing the length aids in decreasing microfiber entanglement, thereby improving the tractability and dispersibility of the microfibers, two properties which are desirable in composite fabrication.

Other features and advantages of the invention will be apparent from the following description of the preferred embodiments thereof, and from the claims.

DESCRIPTION OF THE PREFERRED EMBODIMENTS

Preferred microfibers for the oxidation treatment are carbon fibrils having small diameters (preferably between 3.5 and 75 nanometers) and graphitic layers that are substantially parallel to the fibril axis that are also substantially free of a continuous thermal carbon overcoat, as described in Tennent, U.S. Pat. No. 4,663,230; Tennent et al., U.S. Ser. No. 871,675; Tennent et al., U.S. Ser. No. 871,676, Tennent et al., U.S. Ser. No. 149,573, and Mandeville et al., U.S. Ser. No. 285,817. These fibrils are prepared as described in the aforementioned patent and patent applications.

In general, the fibrils are oxidized by contacting them with a solution of potassium chlorate dissolved in concentrated sulfuric acid. The treatment is conducted at room temperature in air. The initial oxidation reaction creates oxygen-containing functional groups on the surface of the fibrils. Continued exposure to the oxidizing solution cleaves the fibrils, thereby reducing fibril length.

EXAMPLE 1 g of potassium chlorate was dissolved in 50 ml of concentrated sulfuric acid and added slowly to approximately 1-2 g of the above-described carbon fibrils. The oxidation reaction was then allowed to proceed in air for 30 min. Upon stirring, fibrils became suspended in the acidic medium, resulting in a black, gelatinous suspension. Close examination of a more dilute suspension revealed that the fibrils were not uniformly distributed but instead remained associated in clumps. At the end of the reaction, the fibrils were collected on a medium porosity (about 5 μm) frit and washed with about 500 ml each of deionized water (until the filtrate had a ph of about 7) and methanol. Following filtration, all of the fibrils appeared to be retained on the frit. The fibrils were then dried first in a Schlenk tube at 70° C. under vacuum (50 mtorr) and then at 180° C. under flowing nitrogen.

The above procedure was repeated except that the oxidation reaction was allowed to proceed for 24 hours. Following filtration, the filtrate was slightly dark and cloudy, indicating the presence of small particles. Filtration through a 0.22 μm Millipore filter resulted in removal of the particles, indicating an effective length between 5 and 0.2 μm. Thus, this second reaction resulted in chopped-up fibrils having reduced lengths.

Samples from both reactions were then analyzed for carbon and oxygen content to reveal the presence of oxygen-containing groups using XPS spectroscopy. The results, shown in Table I, below, indicate that the oxidation reaction introduces a significant change in the atomic composition. No residual sulfur, chlorine, or potassium was observed. Moreover, a control reaction using only sulfuric acid resulted in no significant change in the atomic composition.

TABLE I

| Sample | % Carbon | % Oxygen |
|---|---|---|
| Pre-oxidation | 98.4 | 1.6 |
| Oxidized 30 min. | 91.9 | 8.1 |
| Oxidized 24 h. | 90.7 | 9.3 |
| $H_2SO_4$, 30 min. | 98.1 | 1.9 |

Other embodiments are within the following claims.

The invention claimed is:

1. A method for decreasing the length of carbon fibrils comprising the step of contacting carbon fibrils with an oxidizing solution under reaction conditions sufficient to decrease the length of said carbon fibrils to less than 5 microns, said carbon fibrils having a diameter less than 1 micron and an original length between 7 and 25 microns, and said carbon fibrils having graphitic layers substantially parallel to the fibril axis, and being substantially free of a continuous thermal carbon overcoat, wherein the length of the projection of the graphitic layers on the fibril axis extends along the axis for a distance of at least two fibril diameters.

2. The method of claim 1 wherein said oxidizing solution comprises two oxidizing agents.

3. The method of claim 1 wherein the diameter of said carbon fibrils is less than about 0.1 micron.

4. The method of claim 1 wherein the fibrils are contacted with said oxidizing solution until the length of said fibrils is between 0.2 and 5 micron.

5. A method for cleaving carbon fibrils comprising the step of contacting a first plurality of carbon fibrils with an oxidizing solution under reaction conditions sufficient to create a second plurality of carbon fibrils, wherein:

the carbon fibrils in both the first and second plurality of carbon fibrils have diameter less than 1 micron, are substantially free of a continuous thermal carbon overcoat, and have graphitic layers substantially parallel to the fibril axis, the length of the projection of the graphitic layers on the fibril axis extending along the axis for a distance of at least two fibril diameters, the carbon fibrils in the first plurality of carbon fibrils have a length between 7 and 25 microns, the carbon fibrils in second plurality of carbon fibrils have a length less than 5 microns, and the number of carbon fibrils in said second plurality of carbon fibrils is greater than the number of carbon fibrils in said first plurality of carbon fibrils.

6. The method of claim 5 wherein said oxidizing solution comprises two oxidizing agents.

7. The method of claim 5 wherein the diameter of said carbon fibrils is less than about 0.1 micron.

8. The method of claim 5 wherein the fibrils are contacted with said oxidizing solution until the length of said fibrils is between 0.2 and 5 micron.

* * * * *